US005466360A

United States Patent [19]

Ehrsam et al.

[11] Patent Number: 5,466,360

[45] Date of Patent: Nov. 14, 1995

[54] METHOD FOR PREPARING ALUMINUM FOR SUBSEQUENT ELECTROPLATING

[75] Inventors: Robert F. Ehrsam, Shelton, Conn.; Robert Z. Reath, 275 West Rd., Easton, Conn. 06612

[73] Assignee: Robert Z. Reath, Easton, Conn.

[21] Appl. No.: 322,930

[22] Filed: Oct. 13, 1994

[51] Int. Cl.[6] ..... C25D 5/22; C25D 5/10; C25D 5/44

[52] U.S. Cl. ..... 205/170; 205/178; 205/181; 205/182; 205/185; 205/206; 427/434.4; 427/436

[58] Field of Search ..... 205/170, 178, 205/181, 182, 185, 206; 427/434.4, 436

[56] References Cited

U.S. PATENT DOCUMENTS

| | | | |
|---|---|---|---|
| 496,176 | 4/1893 | Wegner et al. | 205/213 |
| 1,214,271 | 1/1917 | Bugbee | 205/214 |
| 1,457,149 | 5/1923 | Cunningham | 205/206 |
| 1,971,761 | 8/1934 | Travers | 204/3 |
| 2,036,962 | 4/1936 | Fischer | 204/3 |
| 2,297,241 | 8/1942 | Perner | 117/130 |
| 2,650,901 | 9/1953 | van der Horst | 204/33 |
| 3,390,068 | 6/1968 | Ellis et al. | 204/212 |
| 3,493,474 | 2/1970 | Weber | 204/33 |
| 3,515,650 | 6/1970 | Asada | 204/42 |
| 3,531,379 | 9/1970 | Peach | 204/33 |
| 3,616,289 | 10/1971 | Ellis et al. | 204/26 |
| 3,619,383 | 11/1971 | Eisner | 204/35 |
| 3,619,384 | 11/1971 | Eisner | 204/35 |
| 3,632,406 | 1/1972 | Clough et al. | 117/107.1 |
| 3,699,013 | 10/1972 | Miyata et al. | 204/32 |
| 3,699,014 | 10/1972 | Eisner | 204/35 |
| 3,716,413 | 2/1973 | Eisner | 136/86 A |
| 3,847,660 | 11/1974 | Eisner | 117/212 |
| 4,100,038 | 7/1978 | Jongkind | 204/38 |
| 4,388,159 | 6/1983 | Dockus et al. | 204/33 |
| 4,670,312 | 6/1987 | Ehrsam | 427/438 |

OTHER PUBLICATIONS

Missel, Nickel or Copper Strike Electroplating Bath for Zincated Aluminum, IBM Technical Disclosure Bulletin, vol. 18, No. 10 (Mar. 1976), p. 3414.

Standard Guide for Preparation of Aluminum Alloys for Electroplating, ASTM B 253, pp. 70–76, Jul., 1987.

Modern Electroplating, by Frederick A. Lowenheim, 3rd ed., pp. 591–599 (no date).

*Primary Examiner*—Kathryn Gorgos
*Assistant Examiner*—Edna Wong
*Attorney, Agent, or Firm*—Ware, Fressola, Van Der Sluys & Adolphson

[57] ABSTRACT

A method for preparing aluminum and aluminum alloys includes the step of simultaneously honing the surface of the aluminum or aluminum alloy in a zincating solution. The honing removes the aluminum oxide layer from the surface of the aluminum or aluminum alloy work piece while the zincating solution deposits a layer of zinc on its surface. The zincate-honing may be followed by electroplating.

11 Claims, 2 Drawing Sheets

METHOD FOR PREPARING ALUMINUM FOR SUBSEQUENT ELECTROPLATING

BACKGROUND OF THE INVENTION

Field of the Invention

The present invention generally relates to a method for preparing aluminum and aluminum alloys for subsequent electroplating, and more particularly, to a method that involves mechanical abrasion of an aluminum or aluminum alloy work piece during immersion plating in a bath.

Description of the Prior Art

Aluminum and aluminum alloys are increasingly becoming desirable materials for making lightweight internal combustion engines, such as those used for automobiles, marine inboard engines, marine outboard engines, chain saw, and lawnmower engines. These engines may be made from a wide range of different aluminum alloys. In many instances, no matter which alloy is ultimately used, the cylinder bores of such engines are electroplated with chromium, nickel composite or other alloy to reduce cylinder wear and extend engine life.

It is well known that aluminum and aluminum alloys rapidly develop a naturally occurring oxide film on their surface. It is equally well known that this oxide film is very adherent and provides aluminum and aluminum alloys with very good resistance to corrosion. While the corrosion resistance is desirable in many applications of aluminum and aluminum alloys, this same oxide film makes aluminum and aluminum alloys very difficult metals for applying other metal coatings, such as electroplated chromium, nickel composites, or other alloy because such electroplated materials will not adhere well, if at all, to the oxide film.

Them are many prior art methods for preparing aluminum and aluminum alloy surfaces for electroplating that remove the adherent oxide film. However, of the many prior art processes, only two, the zincate process and Alstan™ process by Atotech Corporation, are used regularly in production and the zincate process is typically employed more than 90% of the time.

The zincate process generally comprises several steps including the mechanical cleaning and acid dipping of a work piece to thoroughly clean the surface and assure that the oxide film is uniform on the surface followed by the immersion of the work piece in a highly alkaline solution of sodium zincate. The sodium zincate solution dissolves the uniform oxide film and deposits a layer of metallic zinc on the oxide-free surface of the work piece by a simple displacement reaction. Once the zinc coating becomes continuous on the surface, the displacement reaction ceases. The zinc coating prevents the oxide from reforming on the surface before the subsequent electroplating of the work piece can be completed.

One drawback of the zincate process is that it does not work well with many alloys. Another drawback is that there is no universal sequence of steps prior to the immersion of the work piece in the zincating bath. Sometimes, as many as twenty separate chemical bath immersion steps or water rinse steps can be involved prior to the zincating immersion step. The particular steps selected ultimately depend upon the type of aluminum alloy work piece that is to be electroplated, and many times, the zincate process usually requires some experimentation with the selection of the processing baths and their sequence of use for each alloy that is to be plated. Also, the control of the steps within the process, including the zincating bath itself, is very critical to the quality of the zinc coating on the aluminum work piece.

The other process, the Alstan™ process, is also used commercially to some extent. This process comprises the usual preparatory cleaning and acid dipping steps followed by immersion of the work piece in a bath which deposits a tin coating rather than a zinc coating. The tin coating roughly serves the same function as the zinc coating obtained by the zincating process. However, unlike the zinc coating, the tin coating must be immediately followed by a bronze electroplate step prior to the final electroplating step to apply the desired metal on the work piece. Thus, the Alstan™ process can add much complexity to the preparation of a work piece for electroplating, for as much as thirty or more processing steps may be needed to prepare a work piece for electroplating. As with most methods, the extra processing steps of the Alstan™ increases the cost, amount of equipment and time required to prepare a work piece for electroplating, and ultimately increase the cost of the finished electroplated work piece.

Until the present invention, it was difficult to find a pre-plating procedure that was equally satisfactory for all types and tempers of aluminum alloys because the various alloys have different electrochemical behavior due to their different compositions and metallurgical structures. See ASTM specification No. B253 entitled "Standard Guide for the Preparation of Aluminum Alloys for Electroplating". For example, in most pre-plating processes, a work piece is degreased, and then subjected to etching in a strong acid or alkali followed by several water rinses to remove the natural oxide film. For each different alloy subjected to this pre-plating etching, the composition of the etching solution may need to be different.

In an effort to develop a completely uniform aluminum surface, from a chemical reactivity point of view, some prior art processes frequently double zincate the work piece, that is, these processes remove an initial zinc film with nitric acid and then reapply a new zinc film. This cycle may be repeated several times to ensure a uniform coating of zinc. Perusal of the multitude of processing choices for preparing aluminum alloys for electroplating in ASTM specification B253 makes clear the problems of cycle development and multitude of steps that might be required.

Thus, because of the large number of alloys, both cast and wrought, involved in the manufacture of engines, it will be readily appreciated by those skilled in the an that there is a need for a simplified, but equally effective, process for preparing all kinds of aluminum and aluminum alloys for electroplating. Without the present invention, which shall be more fully described below, preparing each of the alloys used in modem aluminum engines for electroplating involves substantial resources to develop different processing methods, some of which have a significant number of different steps including acid etching and caustic treatments that can place the aluminum or aluminum alloy workpiece at risk of over etching. A large number of different steps for each alloy processed complicates production, increases costs, and increases the possibility of adhesion failures.

SUMMARY OF THE INVENTION

The present invention is designed to overcome the limitations that are attendant upon the use of the prior art processes for preparing wrought or cast aluminum and aluminum alloys for electroplating, and toward this end, it contemplates a method whereby after an aluminum or aluminum alloy work piece, after having been degreased, is subjected to a simultaneous mechanical honing and zincating step to remove the natural oxide layer and replace it with a uniform layer of zinc.

It is an object of the present invention to provide a simple, reliable, low cost method for preparing aluminum and aluminum alloys for subsequent electroplating.

It is another object of the present invention to provide a method for preparing aluminum and aluminum alloys for subsequent electroplating that requires no etching step.

It is another object of the present invention to provide a universal method for preparing aluminum and aluminum alloys for subsequent electroplating.

These objects are accomplished, at least in part, by a method for preparing aluminum and aluminum alloys for electroplating that includes a step wherein a work piece is honed in a zincate bath.

Other objects and advantages of the present invention will become apparent to those skilled in the art from the following detailed description read in conjunction with the attached drawings and claims appended hereto.

DESCRIPTION OF THE DRAWINGS

The drawings, not drawn to scale, include.

DETAILED DESCRIPTION OF THE PRESENT INVENTION

Figure 1:
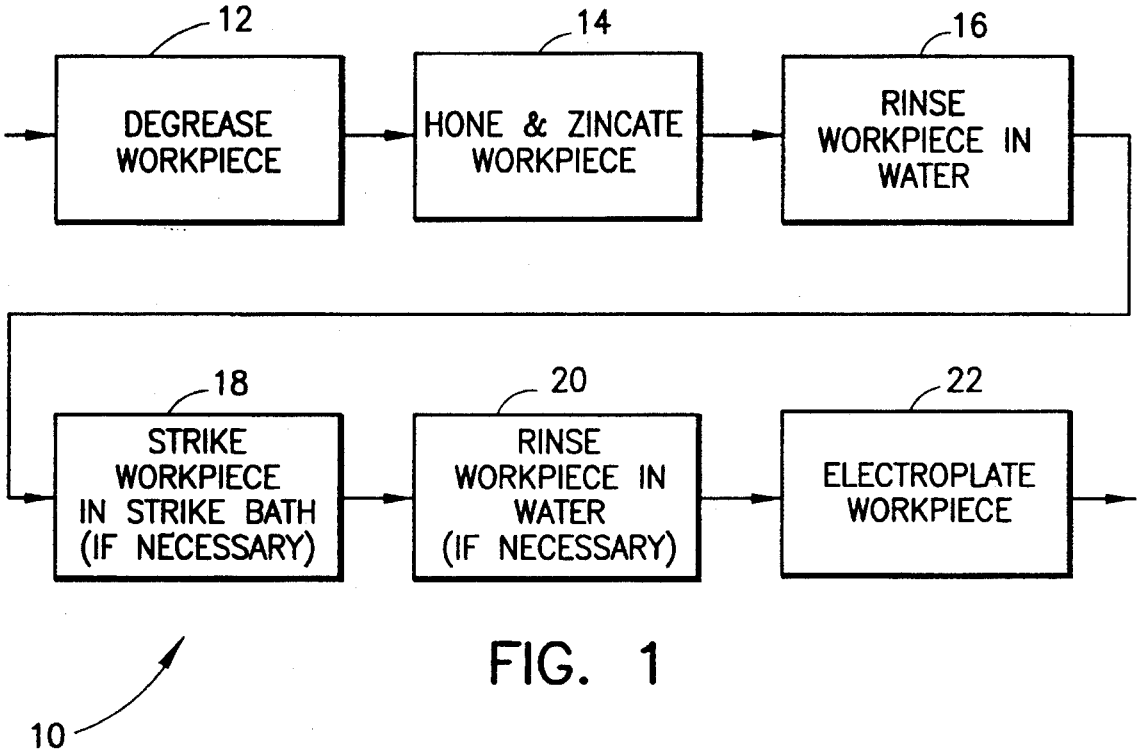
FIG. 1, which is a schematic diagram of a method for electroplating aluminum and aluminum alloys that includes the preparatory method of the present invention.

Referring to FIG. 1, generally indicated therein by the numeral 10 is an electroplating method for electroplating an aluminum or aluminum alloy work piece that incorporates the core steps of the method of the present invention. The electroplating method 10 generally comprises the steps of degreasing the work piece 12, honing the work piece in a zincating bath 14, rinsing the work piece in water 16, strike plating the work piece in a strike bath appropriate for the metal to be electroplated 18, rinse the work piece in water 20 and electroplate the work piece 22. The most important step of the method of the present comprises honing the workpiece in a zincating bath 14. Preferably, the water rinsing steps should be made with deionized water, but those skilled in the art will appreciate that the use of deionized water is not required to practice the present invention.

According to the present invention, the first step 12, degreasing the work piece may be carried out using any standard technology for degreasing typically employed by those skilled in the art. This includes degreasing the work piece in solvents or aqueous solutions.

Figure 2A:
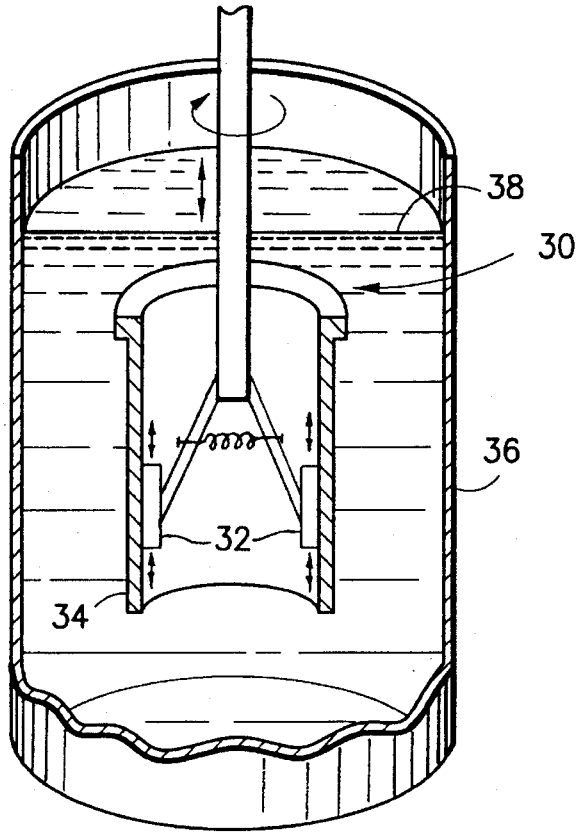
FIG. 2A, which is a partial cross-sectional view of a honing apparatus using a hone with honing stones in an aluminum alloy cylinder sleeve.
Figure 2B:
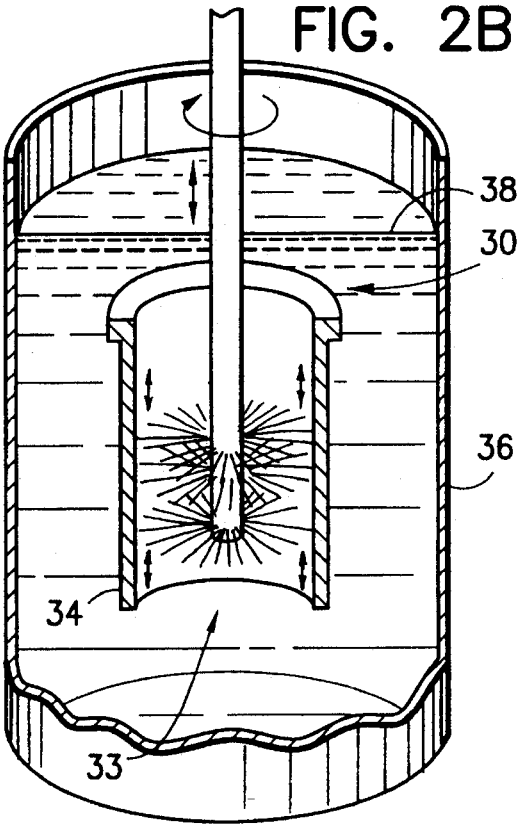
FIG. 2B, which is a partial cross-sectional view of a honing apparatus using a brush impregnated with abrasives.
Figure 2C:
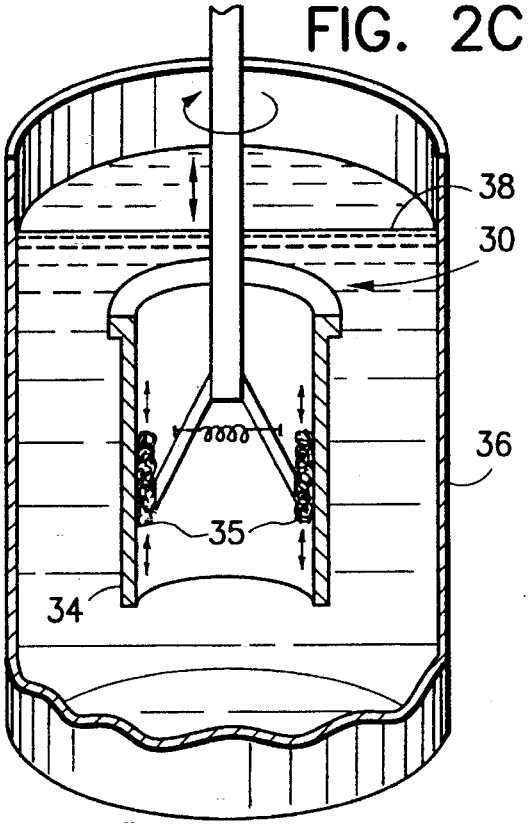
FIG. 2C, which is a partial cross-sectional view of a honing apparatus using a hone with polymeric abrasive pads instead of honing stones.
Figure 2D:
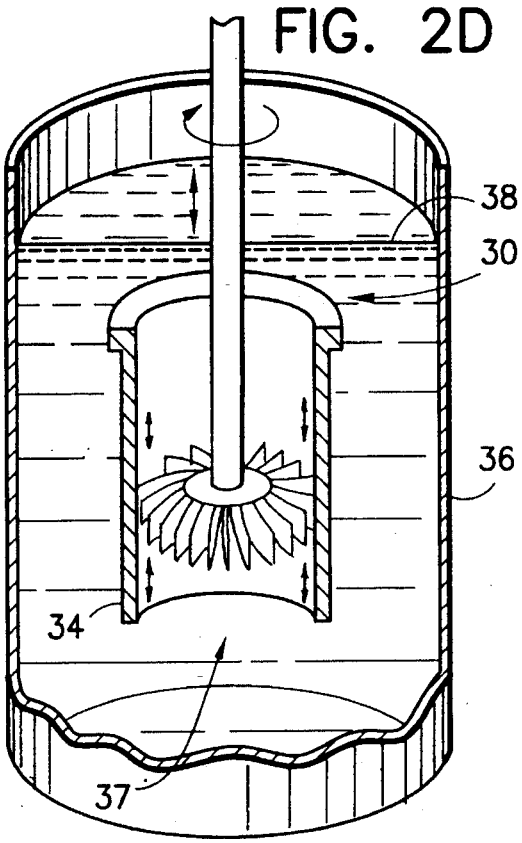
FIG. 2D, which is a partial cross-sectional view of a honing apparatus using a flap wheel made from a plurality of abrasive flaps.
Figure 2E:
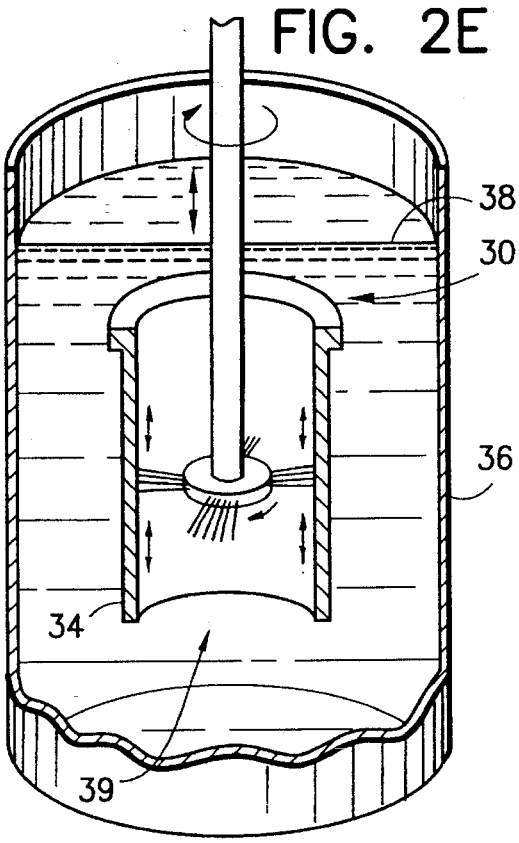
FIG. 2E, which is a partial cross-sectional view of a honing apparatus using a notched abrasive brush.

In the second step 14, the honing of the work piece is carded out with a honing apparatus in a zincate plating solution. A honing apparatus generally indicated by the number 30 as shown schematically in FIG. 2A, is assembled so that honing heads 32 are placed in contact with a surface of the work piece 34. In the example shown in FIG. 2, the work piece is a cylinder liner. The honing assembly 30 can setup so that it may be rotated by a honing machine (not shown). The honing machine may also be used to move the assembly in an up and down motion along the axis of rotation to assure that the entire work piece surface is abraded, since honing heads almost never extend the full length of a work piece 34, such as the cylinder liner shown in FIG. 2A. Those skilled in the art will appreciate that any number of honing heads 32 may be used to carry out the abrasion aspect of the present invention. Also, in lieu of honing heads 32 having fixed stone hones, as shown in FIG. 2B, 2C, 2D and 2E, one may substitute honing brushes 33, brushes in which the bristles have been impregnated with an abrasive, polymeric abrasive pads 35 such as ScotchBrite™ pads by 3M of Minneapolis, Minnesota, a flap wheel 37 which contains a plurality of abrasive papers attached at one end to a hub, such as those manufactured by Weiler Brush Company, Inc. of Cresco, Pennsylvania, or a notched brush 39. It is also possible to use a plain bristle brush and a separate abrasive slurried in the zincating solution.

Critical mechanical operating parameters of the honing assembly 30 include loading on the hones, total hone surface area, degree of abrasiveness of the hones, surface speed of the hones and mean honing time. Whether the honing is done with a drill press using a brake hone, or in a honing machine that can cost as much as a half million dollars, the critical factors enumerated above are the same, and the honing head, whether a stone or brush, is always moved back and forth along the longitudinal axis of the work piece being honed.

More particularly, the honing zincating step 14 is carried out by submersing the honing apparatus and work piece in a reservoir 36 containing a zincating solution 8 so that the entire work piece 34 is submerged and honing for a requisite period of time under parameters suitable for the particular work piece being prepared for electroplating. Examples of zincating solutions and honing parameters for various work pieces is provided in examples described below.

While all of the zincating solutions described in the prior art literature work, it has been found that with the method of the present invention, the concentration of zinc oxide in the zincating bath, preferably, should be maintained between 14 and 300 grams per liter. It has been found that a zinc concentration of approximately 50 grams per liter gives optimum results. Normally, the zincating solution is maintained at a temperature between 18 and 27° C.

After the honing-zincating step 14 is performed for the requisite period of time, the work piece is removed from the reservoir 36 and rinsed, step 16, with water. The work piece 34 may be assembled onto a plating rack for subsequent electroplating.

Once the work piece 34 has been rinsed with water as shown by step 16 in FIG. 1, the work piece 34 is placed in a strike bath appropriate for the metal being plated as shown in step 18. As those skilled in the art will appreciate, a strike bath is an electroplating bath whose formulation and operating conditions favor the quick and complete coverage of the area being plated. Strike plating results in a very thin coating applied in a very brief plating time. For example, in the case of a nickel composite plate, a strike may be made with a tartrate-type copper strike solution or a nickel glycolate strike solution. See, ASTM B253, Reference No. 1. Other metals may require a different strike material and procedures, while chromium plate and electroless nickel plate usually do not require strike steps.

Following the strike plating step 18, the work piece 34 is rinsed with water, as shown in step 20, FIG. 1, and then electroplated to the desired thickness, as shown in step 22. The strike plating step 18 followed by the rinse step 20 are omitted when chromium plating with a hexavalent bath.

The honing-zincating step 14 gives an adhesion of the subsequent electroplate that is equal to or better than that obtained with either of the prior art immersion processes previously described, while eliminating several steps such as etching. While those skilled in the art will appreciate that there are no completely reliable tests for adhesion, and most of the adhesion tests are not quantitative. However, ASTM B571, Reference No. 2, describes a wide variety of empirical tests for adhesion for both wrought and cast alloys, including the Bend Test, Grind-saw Test, Heat-Quench Test and Push Test that are commonly used. Of the various ASTM tests identified above, the Push Test appears to be most predictive of performance in the field. The Push Test results mentioned below for the various examples were conducted by modifying the Push Test to employ a 7.5 mm end mill instead of a conical point drill bit.

EXAMPLE 1

Plating of nickel/silicon carbide composite on UNS A96061 aluminum has been difficult because the aluminum contains magnesium and copper alloying constituents. However, such an alloy was plated by following the steps of method of the present invention. Accordingly, a UNS A96061 work piece was prepared by abrading with a hone having a loading of 330 grams per square centimeter, 4.5 square centimeters of honing stones having a grit size of 200, a hone surface speed of 100 meters per minute for a total of 3 minutes in a zincate solution comprising 120 grams/liter of sodium hydroxide, 30 grams/liter zinc oxide, 50 grams/liter Rochelle salts, 2 grams/liter ferric chloride, hexahydrate, and 1 gram/liter sodium nitrate. The mean honing time was approximately 1.5 minutes. After the honing/zincating step, the work piece was rinsed in water. A nickel glycolate strike was employed after the rinse but before a nickel/composite electroplating step. The nickel/composite plate consisted of a nickel matrix with 8 to 20% finely powdered silicon carbide dispersed uniformly in the coating. A total thickness of the nickel composite plate was 50 micrometers and the adhesion was judged excellent by the modified Push Test.

EXAMPLE 2

Plating chromium on UNS A96061 aluminum was accomplished according to the same method and parameters described in Example 1, except that no nickel glycolate and subsequent rinsing step was necessary. The total thickness of chromium was 25 micrometers and the adhesion was found to be excellent by both the modified Push Test and the Quench Test.

EXAMPLE 3

Plating nickel/silicon carbide composite on UNS A03800 aluminum, a very high silicon east alloy used in engine blocks and small engine cylinders, was plated according to the same procedure and parameters outlined in Example 1. The total thickness of the composite plate was 50 micrometers and the adhesion was determined to be excellent by the modified Push Test.

EXAMPLE 4

Plating chromium on UNS A03800 aluminum was accomplished using the same method and parameters as described in Example 2. The chromium plating thickness was 25 micrometers and adhesion was judged as excellent by the modified Push Test.

EXAMPLE 5

Plating nickel/silicon carbide composite on UNS A96061 aluminum was accomplished using the same method as described in Example 1, except a fiber brush with a diameter of 6 mm larger than the cylinder bore was employed and a slurry of grit pumice was added to the zincating solution. The surface speed of the brush was 100 meters/minute but the mean honing time was reduced to 30 seconds. The thickness of the composite plate was 50 micrometers and its adhesion was determined to be excellent by the modified Push Test.

EXAMPLE 6

Aluminum alloy UNS A03800 was plated according to the same steps and parameters described in Example 5. The adhesion of the 25 micrometer plate was judged as excellent by the modified Push Test.

EXAMPLE 7

Plating nickel/silicon carbide composite on UNS A96061 aluminum alloy was accomplished by the same method and parameters described in Example 1, except that the zincating solution employed comprised 40 grams/liter of sodium hydroxide, 14 grams/liter zinc oxide, 50 grams/liter Rochelle salt, 2 grams/liter ferric chloride, hexahydrate and 1 gram/liter sodium nitrate. The thickness of the electrodeposited nickel/silicon carbide composite was 50 micrometers and its adhesion was excellent by the modified Push Test.

EXAMPLE 8

Plating nickel/silicon carbide composite on UNS A96061 aluminum alloy was accomplished by the same method and parameters described in Example 1, except that the zincating solution employed comprised 525 grams/liter of sodium hydroxide, 100 grams/liter of zinc oxide, 10 grams/liter Rochelle salt, and 1 gram/liter ferric chloride hexahydrate. The adhesion of the 50 micrometer thick nickel/silicon carbide composite plate was determined to be excellent by the modified Push Test.

EXAMPLE 9

Plating nickel/silicon carbide composite on UNS A96061 aluminum alloy was accomplished by the same method and parameters described in Example 1, except that a hone using Scotch-Brite™ abrasive pads was employed. The surface speed of the hone pads was 100 meters/minute and the mean honing time was 30 seconds. The thickness of the composite plate was 50 micrometers and its adhesion was determined to be excellent by the modified Push Test.

EXAMPLE 10

Plating chromium on UNS A96061 aluminum alloy was accomplished according to the same method and parameters described in Example 2, except that the mean honing time was 30 seconds. The total thickness of chromium was 25 micrometers and the adhesion was found to be excellent by the modified Push Test.

EXAMPLE 11

Plating nickel/silicon carbide composite on UNS A96061 aluminum alloy was accomplished using the same method described in Example 1, except that an abrasive flap wheel of 180 grit with a diameter of 4 mm larger than the cylinder bore was employed. Surface speed of the flap wheel was 100 meters per minute and a mean hone time of 30 seconds was used. The thickness of the composite plate was 50 micrometers and its adhesion was determined to be excellent by the modified Push Test.

EXAMPLE 12

Plating chromium on UNS A96061 was accomplished using the same method and parameters as described in Example 2, except that the mean honing time was 30 seconds. The chromium plating thickness was 25 micrometers and its adhesion was excellent by the modified Push Test.

The embodiments disclosed herein admirably achieve the objects of the present invention; however, it should be appreciated by those skilled in the art that departures can be made by those skilled in the art without departing from the spirit and scope of the invention which is limited only by the following claims.

What is claimed is:

1. A method for preparing a surface of an aluminum or aluminum alloy work piece for subsequent electroplating, the method comprising the step of honing the surface of the aluminum or aluminum alloy work piece while the surface is immersed in a zincate solution so as to substantially remove any aluminum oxide layer and deposit a layer of zinc on the surface.

2. The method of claim 1, wherein honing the surface of the work piece is performed with a honing stone.

3. The method of claim 1, wherein honing the surface of the work piece is performed by brushing the work piece surface with an abrasive honing brush.

4. The method of claim 1, wherein honing the surface of the work piece is performed by adding abrasive particles to the zincate solution and by brushing the work piece surface with a fiber brush.

5. The method of claim 1, wherein honing the surface of the work piece is performed with a polymeric abrasive pads.

6. The method of claim 1, wherein honing the surface of the work piece is performed with a flap wheel.

7. The method of claim 1, wherein honing the surface of the work piece is performed with a notched brush.

8. A method for preparing a surface of an aluminum or aluminum alloy work piece for subsequent electroplating, the method comprising the steps of:

(a) degreasing the surface of the aluminum or aluminum alloy work piece to remove oily soil and dirt therefrom;

(b) immersing the degreased surface of the aluminum or aluminum alloy work piece in a zincate solution; and (c) honing the immersed, degreased surface of aluminum or aluminum alloy work piece for a period of time to remove any aluminum oxide layer and deposit a layer of zinc on the surface of the aluminum or aluminum alloy work piece.

9. A method for electroplating a surface of an aluminum or aluminum alloy work piece, the method comprising the steps of:

(a) degreasing the surface of the aluminum or aluminum alloy work piece to remove oily soil and dirt therefrom;

(b) immersing the degreased surface of the aluminum or aluminum alloy work piece in a zincate solution;

(c) honing the immersed, degreased surface of aluminum or aluminum alloy work piece for a period of time to remove any aluminum oxide layer and deposit a layer of zinc on the surface of the aluminum or aluminum alloy work piece;

(d) removing the surface of the aluminum or aluminum alloy work piece from the zincate solution and rinsing the surface with water;

(e) immersing the surface of the aluminum or aluminum alloy work piece in an electroplating bath and electroplating the surface for a period of time to form an electroplated metallic coating on the zincated surface of the aluminum or aluminum alloy work piece.

10. The method of claim 9, wherein between steps (d) and (e), the method further comprises the steps of:

immersing the surface of the aluminum or aluminum alloy work piece in a strike electroplate bath for a period of time to form a metallic strike layer over the zinc layer; and removing the surface of the aluminum or aluminum alloy work piece from the strike electroplate bath and rinsing the surface with water;

11. The method of claim 9, wherein the zincating solution includes zinc oxide in the range of 14 to 300 grams/liter.

* * * * *